US007748656B1

(12) United States Patent
Lo

(10) Patent No.: US 7,748,656 B1
(45) Date of Patent: Jul. 6, 2010

(54) PAPER SHREDDER BLADE

(76) Inventor: Emily Lo, No. 18, 20 Lane, Hsin Feng Street, Hsin Chuang, Taipei Shien (TW)

( * ) Notice: Subject to any disclaimer, the term of this patent is extended or adjusted under 35 U.S.C. 154(b) by 0 days.

(21) Appl. No.: 12/080,473

(22) Filed: Apr. 2, 2008

(51) Int. Cl.
*B02C 18/16* (2006.01)

(52) U.S. Cl. ..... 241/295

(58) Field of Classification Search ..... 241/236, 241/294, 295

See application file for complete search history.

(56) References Cited

U.S. PATENT DOCUMENTS 3,323,567 A * 6/1967 Segal ..... 144/223
6,089,482 A * 7/2000 Chang ..... 241/236
6,983,903 B2 * 1/2006 Chang ..... 241/236
7,401,747 B2 * 7/2008 Bai ..... 241/295
2002/0096584 A1 * 7/2002 Ho ..... 241/236

* cited by examiner

*Primary Examiner*—Mark Rosenbaum

(57) ABSTRACT

A paper shredder blade includes a pair of cylindrical hobs, and each hob includes a polygonal shaft sheathed with many differential blades, allowing the differential blades to be assembled alternately. Each differential blade has two secondary blades, and an inner side of each secondary blade contains many bumps surrounding an inner rim of the secondary blade to increase a thickness and an intensity of the blade. Two abutted secondary blades are formed into one set of differential blade by abutting the bumps with the bumps, to save more than a half of materials of the differential blade, and to reduce a weight correspondingly. A cut-off edge of each secondary blade contains a reinforcing rib, allowing the edge to be thicker than the cut-off edge of an ordinary paper shredder. Therefore, when cutting off paper, the paper will not be jammed easily and can be cut off easily.

2 Claims, 3 Drawing Sheets

PAPER SHREDDER BLADE

BACKGROUND OF THE INVENTION a) Field of the Invention

The present invention relates to a paper shredder blade, and more particularly to a differential blade of a paper shredder blade tool, wherein a plurality of bumps are provided on the differential blade to increase a thickness of a secondary blade and to enhance an intensity of the blade, and two secondary blades are formed into a set of differential blade by abutting the bumps with the bumps, so as to save materials. In addition, a reinforcing rib is provided on a cut-off edge of the secondary blade; therefore, a blade edge will be thicker, such that when cutting off paper at a same time, the paper can be cut off easily by the secondary blades without being prone to be jammed.

b) Description of the Prior Art

Referring to FIG. 1, a conventional paper shredder blade tool is constituted by two cylindrical hobs 1, 1'. Each hob includes a polygonal shaft 2 and a plurality of differential blades 4 sheathed on the shaft 2, and a gasket 6 is provided between two neighboring differential blades 4 to separate the blades 4, allowing the differential blades 4 on the two cylindrical hobs to be assembled alternately. Referring to FIG. 2, each differential blade 4 is formed by two sets of secondary blades 4*a* abutted back to back, and a circumference of each secondary blade 4*a* is provided with a plurality of cut-off edges 4*b*. When the cut-off edges 4*b* of the paper shredder are cutting off paper, the paper will be cut off at a same time by the cut-off edges 4*b*. A single sheet of paper is easily cut off, whereas when cutting off the plural sheets of paper, a larger output horsepower will be needed, a louder noise will be created and a force sustained by a driving gear of the paper shredder will be relatively larger, such that teeth on the gear can be broken.

SUMMARY OF THE INVENTION

Accordingly, the primary object of the present invention is to provide a paper shredder blade, wherein each secondary blade of a differential blade of a paper shredder blade tool is provided with a plurality of bumps to increase a thickness of the blade and to enhance an intensity of the blade, two secondary blades are formed into a set of differential blade by abutting the bumps with the bumps to save cost, and a reinforcing rib is provided on a cut-off edge to have a thicker edge. Therefore, when the paper shredder is shredding paper, an output horsepower required will be smaller, a noise will be less louder, a force sustained by a driving gear will be relatively smaller, the differential blade will be lighter in weight and have a stronger intensity, and only less than a half of materials used in the conventional secondary blades of the paper shredder are needed; therefore, the paper will not be jammed easily and the paper cut-off operation can be performed smoothly.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
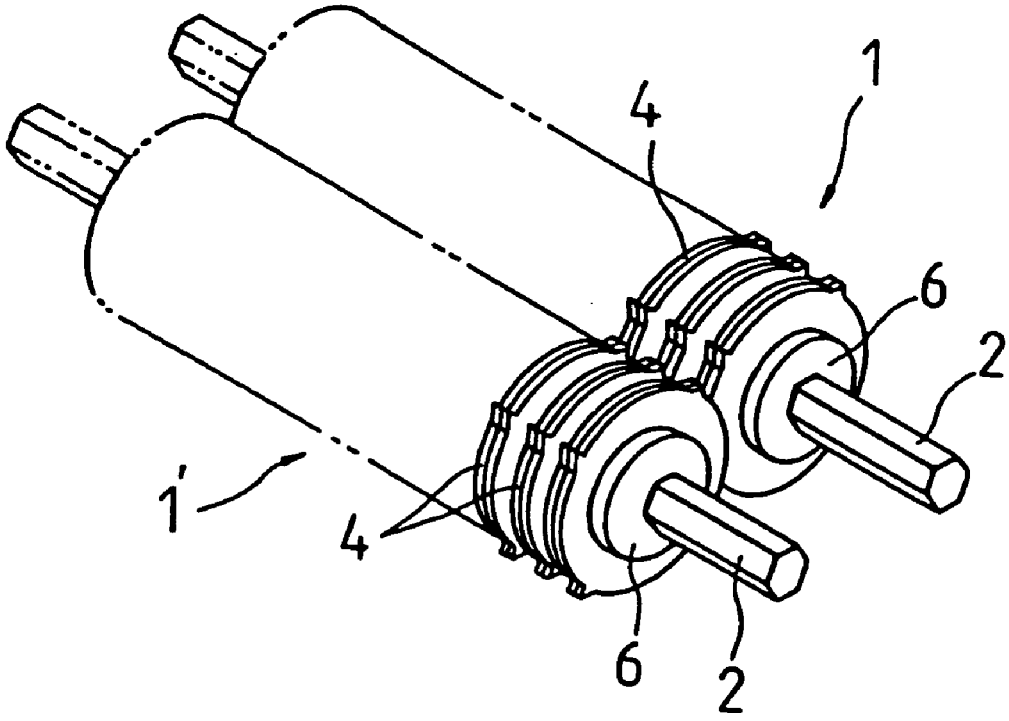
FIG.1 (PRIOR ART)
FIG. 1 shows a perspective view of a conventional paper shredder blade tool.
Figure 2:
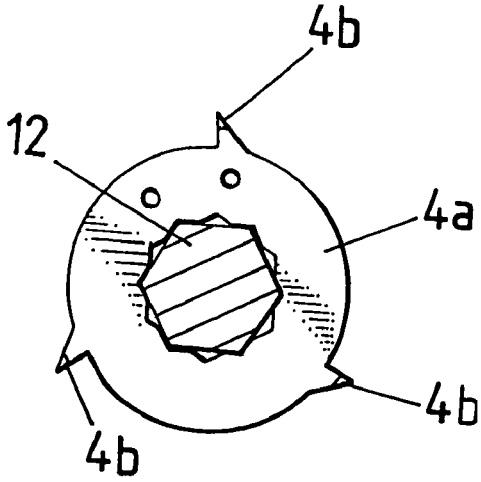
FIG.2 (PRIOR ART)
FIG. 2 shows a plan view of a conventional secondary blade of a paper shredder blade tool.
Figure 3:
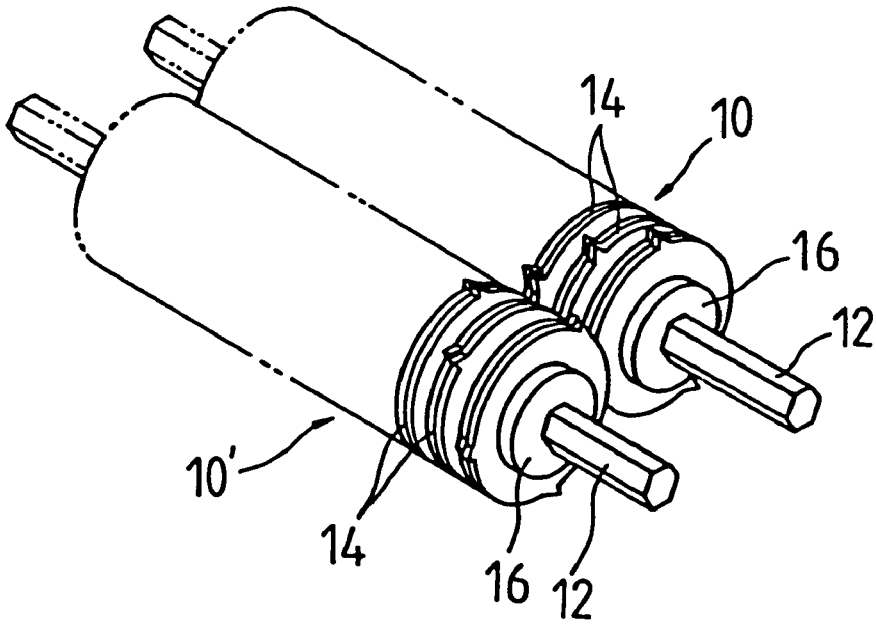
FIG. 3 shows a perspective view of the present invention.
Figure 4:
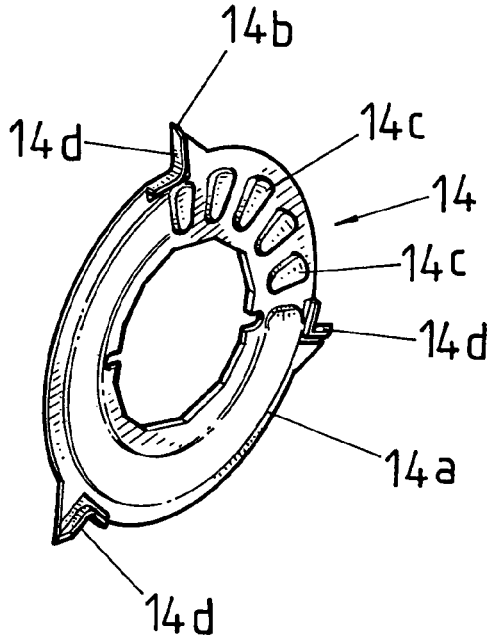
FIG. 4 shows a perspective view of a differential blade of the present invention.
Figure 5:
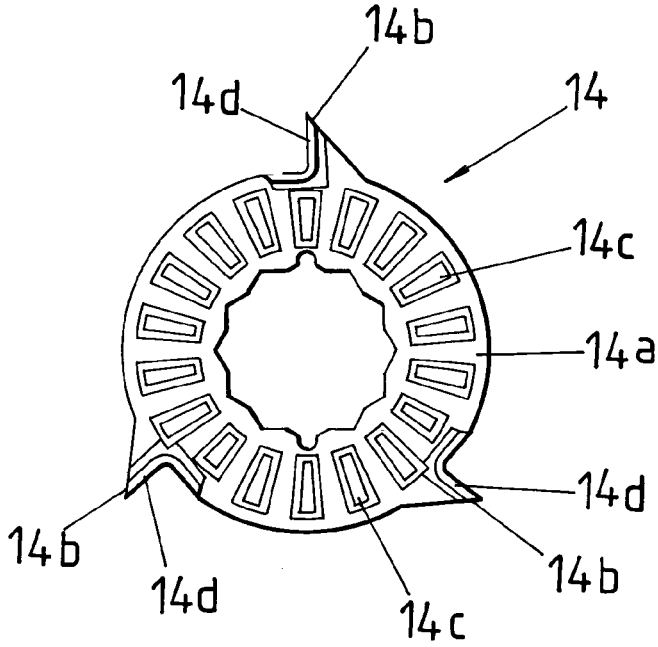
FIG. 5 shows a plan view of a differential blade of the present invention.

Referring to FIG. 3, a paper shredder blade of the present invention is constituted by two cylindrical hobs 10, 10'. Each hob includes a polygonal shaft 12 and a plurality of cutting blades, which according to the present invention are differential cutting blades 14, sheathed on the shaft 12. A gasket 16 is provided between two neighboring differential blades 14 to separate the blades 14, allowing the two differential cutting blades 14 on the two cylindrical hobs 10, 10' to be assembled with the differential cutting blades of the respective hobs being alternately positioned such that the assembly has the differential cutting blades interleaving at a midpoint between the hobs to form a cutting nip as shown in FIG. 3. Referring to FIGS. 4 and 5, each differential blade 14 on the hobs 10, 10' is formed by a set of two secondary blades 14*a* abutted back to back, and a circumference of each secondary blade 14*a* is provided respectively with more than one set of cut-off edges 14*b*, such that paper can be cut off by the corresponding cut-off edges 14*b* on the two abutted secondary blades 14*a*.

An inner side (i.e. the back side in the back-to-back assembly) of each secondary blade 14*a* of each differential blade 14 is protruded with a plurality of bumps 14*c*. These rectangular bumps 14*c* surround an inner rim of the secondary blade 14*a* to enhance an entire cutting intensity of the secondary blade 14*a* and to raise a thickness of the secondary blade 14*a*. The set of two abutted secondary blades 14*a* are formed into one differential blade 14 by abutting the bumps 14*c* with the bumps 14*c*, so as to save cost.

The cutting edge 14*b* of the secondary blade 14*a* is an edge bended by 90 degrees, and an outer rim of the cutting edge 14*b* is provided with a laterally projecting reinforcing rib 14*d* to enhance the cutting intensity of the cut-off edge 14*d*, thereby forming the thick and solid cut-off edge 14*b*. As the edge of the cut-off edge 14*b* is thicker than an edge of an ordinary paper shredder, a paper cutting power will be strong and powerful, and the paper will not be jammed easily.

In operating, the cut-off edges 14*b* of the differential cutting blades 14, which are installed alternately, on the two hobs of the paper shredder blade tool of the present invention, are oppressed toward paper; and each strip of paper debris is cut off into sections of debris by the annular blades at outer rims of the secondary blades 14*a*, to assure confidentiality. Besides, due to a unique structural design of the paper shredder blade tool of the present invention, all the secondary blades 14*a* on the blade tool 10 are provided with the reinforcing bumps 14*c*, and the cut-off edges 14*b* at the most outer rims are thicker and more solid structures. On the other hand, where the two differential cutting blades 14 of the two hobs 10, 10' are interleaving, the cut-off edges 14*b* of one differential cutting blade 14 on one hob are abutted on an outer surface of the adjacent differential cutting blade 14 on the other hob (two abutted secondary blades 14*a* are formed into one set of differential cutting blade 14 by abutting the bumps 14*c* with the bumps 14*c*), so as to achieve an improved function of high quality, high efficiency, low noise and low cost.

In conclusion, the paper shredder blade of the present invention is an innovative paper shredder blade tool which can efficiently and accurately eliminate the drawbacks of the existing paper shredder.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A paper shredder blade for a paper shredder comprising two cylindrical cutting hobs rotating opposite to each other, with each hob including a polygonal shaft and a plurality of differential cutting blades mounted on the shaft, and a gasket being provided between two neighboring differential cutting blades, allowing the differential cutting blades on the two cylindrical hobs to be assembled alternately, with the cutting blades interleaving at a midpoint between the shafts to form a cutting nip;

wherein each cutting blade is a differential blade is constituted by a set of two abutted secondary blades, each formed with at least one cut-off edge which is protruded outward from the circumference thereof, and an inner side secondary blades of the differential blade having a plurality of protruding standoff bumps surrounding an inner rim of the secondary blade; the two abutted secondary blades being formed by abutting the standoff bumps of one secondary blade with the standoff bumps of another secondary blade.

2. The paper shredder blade for a paper shredder as claimed in claim 1; wherein an outer rim of the cut-off edge is provided with a laterally projecting reinforcing rib to enhance a cutting intensity and thickness of the cut-off edge.

* * * * *